US012498207B1

(12) United States Patent
Ko

(10) Patent No.: US 12,498,207 B1
(45) Date of Patent: Dec. 16, 2025

(54) MAGAZINE CARRIER

(71) Applicant: CONDOR OUTDOOR PRODUCTS, INC., Irwindale, CA (US)

(72) Inventor: Henry Ko, Irwindale, CA (US)

( * ) Notice: Subject to any disclaimer, the term of this patent is extended or adjusted under 35 U.S.C. 154(b) by 0 days.

(21) Appl. No.: 18/984,802

(22) Filed: Dec. 17, 2024

Related U.S. Application Data

(60) Provisional application No. 63/621,987, filed on Jan. 17, 2024.

(51) Int. Cl.
*F42B 39/02* (2006.01)

(52) U.S. Cl.
CPC ..... *F42B 39/02* (2013.01)

(58) Field of Classification Search
CPC ..... F42B 39/02; F42B 39/00; F42B 39/26; F41C 33/02; Y10S 224/914; A45F 5/02; A45F 5/021; A45F 5/08
See application file for complete search history.

(56) References Cited

U.S. PATENT DOCUMENTS 3,623,256 A * 11/1971 Shiplee, III ..... F41A 9/63 42/50
5,152,442 A * 10/1992 Gallagher ..... F42B 39/02 224/931
5,174,482 A * 12/1992 Rogers ..... F42B 39/02 224/679
6,154,997 A * 12/2000 Aluotto ..... F41C 33/02 224/931
6,202,908 B1 3/2001 Groover
7,562,482 B1 7/2009 Johnson
7,918,371 B2 * 4/2011 Wilson ..... F41A 9/65 224/931
8,011,544 B1 9/2011 Howell
8,485,405 B2 * 7/2013 Crye ..... F42B 39/02 224/931
8,887,977 B2 11/2014 Ralph
9,097,489 B2 * 8/2015 Chiang ..... F41C 27/00
10,306,973 B2 * 6/2019 Evans ..... F42B 39/02
10,537,167 B2 * 1/2020 Bryant ..... F42B 39/02
10,612,888 B2 * 4/2020 Toschi ..... F41C 33/04
10,928,172 B1 * 2/2021 Mironski ..... F42B 39/02
11,033,095 B1 * 6/2021 VanHeusen ..... A45F 5/00
11,821,720 B2 11/2023 Isaacson et al.
2007/0278269 A1 12/2007 Rogers et al.
2011/0107645 A1 * 5/2011 Faifer ..... F42B 39/02 42/90

(Continued)

*Primary Examiner* — Joshua E Freeman
(74) *Attorney, Agent, or Firm* — Clement Cheng

(57) ABSTRACT

A magazine carrier has a frame insert that includes a bottom frame wall, a right frame wall, and a left frame wall. The bottom frame wall connects to the right frame wall and the left frame wall. A retainer plate has a retainer plate lower edge opposite the retainer plate upper edge, and a retainer plate right edge opposite a retainer plate left edge. The retainer plate further includes protrusions. The frame insert is retained within the outer portion and the retainer plate retains within the outer portion. The outer portion is formed as a flexible container with a carrier opening that receives the frame insert and retainer plate. The outer portion includes an outer portion right wall and an outer portion left wall. The outer portion right wall and the outer portion left wall join at an outer portion middle wall.

16 Claims, 5 Drawing Sheets

(56) References Cited

U.S. PATENT DOCUMENTS

| | | | | |
|---|---|---|---|---|
| 2014/0262842 | A1* | 9/2014 | Beck | F42B 39/26<br>29/428 |
| 2016/0003598 | A1* | 1/2016 | Gadams | B65D 25/04<br>224/191 |
| 2020/0232738 | A1* | 7/2020 | LeMarbe | A45F 3/06 |
| 2022/0095773 | A1* | 3/2022 | Yeates | F41C 33/041 |
| 2022/0155047 | A1* | 5/2022 | Smith | F42B 39/02 |
| 2022/0325998 | A1* | 10/2022 | Isaacson | F42B 39/02 |
| 2023/0258440 | A1* | 8/2023 | Chambers | F42B 39/26<br>206/3 |
| 2024/0110772 | A1* | 4/2024 | Cragg | F42B 39/02 |
| 2025/0109928 | A1* | 4/2025 | Daly | F42B 39/02 |

* cited by examiner

MAGAZINE CARRIER

FIELD OF THE INVENTION

The present invention is in the field of magazine carriers.

DISCUSSION OF RELATED ART

A variety of different magazine carriers have been discussed in United States patents. For example, in U.S. Pat. No. 5,152,442 entitled "Cartridge Clip Case" by inventor Richard N. Gallagher, published Oct. 6, 1992, the inventor describes, "A case for storing and transporting a clip of cartridges which are fired in a gun. A user can remove the clip from the case be inserting his thumb intermediate the clip and backing of the case and by grasping the clip between his thumb and forefinger."

For example, in U.S. Pat. No. 6,154,997 issued Dec. 5, 2000, entitled "Magazine Pouch", by Peter A. Aluotto and John A. Gluardo, the inventors describe, "A magazine pouch has a backing plate with an upper portion and a lower portion. The upper portion has a channel oriented longitudinally along said backing plate. A retainer is slidingly disposed in the channel and fixable in several preselected positions. The lower portion has a magazine box in which a magazine may be disposed. The magazine box includes a front wall and an opening facing the channel. The front wall includes a tab adjacent the opening. The tab is resilient, and, in matter of a spring, keeps a magazine secured under the retainer, yet enables the magazine to be quickly removed from the pouch."

For example, in U.S. Pat. No. 6,202,908, issued Mar. 20, 2001, entitled "Spare Magazine Carrier with Retractable Flap", by J. Steven Groover, the inventor describes, "A spare magazine carrier for carrying at least one ammunition magazine on a user's person. The spare magazine carrier has a carrier frame for seating and supporting at least one ammunition magazine, and a downwardly retractable flap for covering and retaining the seated ammunition magazine. The flap has an elastic member connecting a lower flap end with an upper flap end. The lower flap end is secured to a lower portion of the carrier frame, and the upper flap end is detachable securable to a top end of the carrier frame by resiliently extending over and around an upper exposed portion of the seated ammunition magazine in a preferably inverted U-shaped configuration. When the upper flap end to retract down and away from the opening, and thereby allow unobstructed access to the ammunition magazine."

For example, in U.S. Pat. No. 7,562,482, issued Jul. 21, 2009, entitled "Spare Magazine Carrier with Independent Latch Mechanism", by David A. Johnson, the inventor describes, "A protective carrier to hold a loaded spare magazine in a position of readiness for immediate insertion into operative engagement with a firearm. A latch release mechanism is operable wholly independent of the operation of the magazine release mechanism of the firearm, so that a spare magazine will remain in the protective carrier despite release of a magazine from the firearm. The spare magazine can be released from the carrier by pressing a latch release lever located for convenient use by either a left-handed or a right-handed rifleman."

For example, in U.S. Pat. No. 8,011,544, issued Sep. 6, 2011, entitled, "Hinged Pocket", by Frank A. Howell, the inventor describes, "A pocket for an article having oppositely facing sides, comprising a front component cooperating in a nested relationship with a back component to define a chamber having an open upper end sized to receive the article. The front and back components, when in their nested relationship, having confronting front and back walls and overlapping bottom walls closing the lower end of the chamber. The bottom walls are interconnected in a manner accommodating movement of the front component relative to the back component between a closed position at which the sides of an article received in the chamber via the open upper end are tightly confined between the front and back walls, and a release position at which the front wall is deflected away from the back wall to accommodate removal of the article from the chamber via the open upper end. A back mounting bar extends across and cooperates in spaced relationship with the exterior of the back wall to define parallel back channels. A pair of flexible mounting straps have lower ends and upper ends joined by a transverse web. The mounting straps extend downwardly through the back channels along the exterior of the back wall. The lower ends of the mounting straps are detachably connected to one of the bottom walls. The mounting straps cooperate with the exterior of the back wall to define a belt receiving slot."

For example, in U.S. Pat. No. 8,485,405, issued Jul. 16, 2013, entitled, "Ammunition Magazine Carrying Device", by Caleb Clark Crye, the inventor describes, "A device for carrying an ammunition magazine has a band which encircles a conventional magazine and which has two downwardly extending plastic tabs. The two plastic tabs are spaced sidewardly to define an downwardly opening, downwardly extending gap, which permits the tabs to be received within openings in two adjacent loops presented by a standard MOLLE webbing on a Pouch Attachment Ladder System or PALS grid on a vest or other clothing item. The tabs are shaped to slide behind standard MOLLE webbing and engage the webbing to hold the magazine securely until the user grabs the magazine and pulls it away from the MOLLE webbing. The tabs are biased towards the magazine, and have a lower protrusion which engages beneath a belt, allowing the same device to be attached to a belt."

For example, in U.S. Pat. No. 8,887,977, issued Nov. 18, 2014, entitled, "Magazine Carrier", by Douglas Ralph, the inventor describes, "A munitions carrier. The carrier securely retains a magazine and provides for rapid deployment of the magazine. The carrier is box-like and has one or more open ends. Four faces are sized and shaped to engage the four longitudinal faces of a magazine. The carrier has inside contours which can engage a complementary area of the outfeed end of a magazine. The carrier made from a material is flexible and has memory for returning to a configuration for retaining a magazine. At least two faces are discontiguous with each other and can be separated from each other. A retained magazine can be disengaged from the carrier and rapidly deployed if a multi-vectored force is applied to the magazine."

For example, in U.S. Pat. No. 9,097,489, issued Aug. 4, 2015, entitled, "Gun Magazine Pouch", by Charlie W. Chiang, the inventor describes, "A magazine holder for use with a gun includes a cavity configured to receive at least two magazines and a biasing member I the cavity and configured toe engage at least one magazine located in the cavity of maintain the at least one magazine in the cavity."

For example, in U.S. Pat. No. 10,306,973, issued Jun. 4, 2019, entitled, "Expandable Carry Pouch with Variable Compression", by Scott Evans and Nicholas Tomczak, the inventors describe, "An expandable, variable compression pouch with an exoskeleton construction, which is a hybrid construction that combines a soft, flexible shell with semi-flexible molded outer components on the back, sides, bottom and front of the flexible shell. These molded components form an exoskeleton that provides structural reinforcement where needed without limiting the essential qualities of expansion or contraction or form fit that is essential to achieve the unique features and superior function of the pouch of the present invention."

For example, in U.S. Pat. No. 10,537,167, issued Jan. 21, 2020, entitled, "Self-Adjusting Variable Size Holster", by Richard Bryant and Jeffrey Brodsky, the inventors describe, "A self-adjusting holster includes first and second shell portions having opposite side panels extending substantially parallel to each other. At least one of the first and second shell portions having a bottom panel. The side panels of the first shell portion and side panels of the second shell portion are configured to telescopically mate such that the mated shell portions slidably adjust relative to each other in a first direction and together define an interior space and an open end opposite the bottom panel. An elastomeric member is configured to bias the shell portions toward each other along the first direction. An item inserted into the open end between the first and second shell portions displaces the shell portions relative to each other against biasing force provided by the elastomeric member."

For example, in U.S. Pat. No. 10,612,888, issued Apr. 7, 2020, entitled, "Elasticized Carrier for Accessories of Different Sizes" by Francesco Toschi, the inventor describes, "An accessory holder includes a housing, within which an accessory can be replaced during use, and includes a first lateral wall, a second lateral wall, a front anterior wall, a front posterior wall arranged so that the front anterior and posterior walls are interposed between the first and the second lateral wall, and a base closing the housing on the lower side. The lateral and frontal walls and the base are independent elements each made as a single piece, detached from one another and connected to one another by an elastic member."

For example, in U.S. Pat. No. 11,821,720, issued Nov. 21, 2023, entitled, "Elastic Magazine Pouch", by Elie Isaacson and Israel Friedman, the inventors describe, "A magazine accessory includes a magazine pouch including a body constructed of an elastic material, and a flared mouth element constructed of an elastomeric material which is stiffer than the elastic material of the body. The flared mouth element is coupled to the body to form a stay-open pouch entrance."

For example, in United States patent publication number 2007/0278269, issued Dec. 6, 2007, entitled, "Pivoting Magazine Holser", by William H. Rogers and Matthew E. McKendrick, the inventors describe, "A magazine holster includes an elongated hollow housing for carrying a spring-loaded magazine carrier therein. A pivot body is mounted by a pivot to the lower part of the housing for movement of the housing to at least one position away from body armor worn by a user. Movement of the housing may be selectable at various locations along an arc from the pivot. A clamp bracket attaches the pivot body to a duty belt. A lockable strap fits over a magazine carried downwardly to secure it in a stored position."

For example, in United States patent publication number 2011/0107645, issued May 12, 2021, entitled, "Magazine Carrier", by Tuvia Faifer, the inventor describes, "A magazine carrier for a firearm, the magazine carrier including a frame having walls to releasably hold an ammunition magazine, and an external track element defined on the frame for engaging a complementary engagement element. The complementary track element can be on a clip, on an adapter or on another similar frame."

For example, in United States patent publication number 2022/0155047, issued May 19, 2022, by Darrell Keith Smith and Daniel Logan Chaney, the inventors describe, "A carrier device includes: a first panel having hooks, and an inward side, the inward side facing an interior of the carrier device; a second panel having an inward side, the inward side facing the interior of the carrier device opposite the inward side of the first panel; and a binding member for releasably connecting the hooks of the first panel to the second panel. The first panel includes an exterior surface opposite the inward side thereof. All portions of the hooks are flush or sunken relative to the exterior surface of the first panel. The binding member draws lateral edges of the first panel toward lateral edges of the second panel to maintain frictional engagement of an inserted magazine or other article with interior contact points of the carrier device. The panels may include mounting holes for mounting the carrier on another device or structure."

SUMMARY OF THE INVENTION

A magazine carrier has a frame insert that includes a bottom frame wall, a right frame wall, and a left frame wall. The bottom frame wall connects to the right frame wall and the left frame wall. A retainer plate has a retainer plate lower edge opposite the retainer plate upper edge, and a retainer plate right edge opposite a retainer plate left edge. The retainer plate further includes protrusions. The frame insert is retained within the outer portion and the retainer plate retains within the outer portion. The outer portion is formed as a flexible container with a carrier opening that receives the frame insert and retainer plate. The outer portion includes an outer portion right wall and an outer portion left wall. The outer portion right wall and the outer portion left wall join at an outer portion middle wall.

The protrusions are preferably rib protrusions that extend from the retainer plate left edge to the retainer plate right edge. The left frame wall has a left frame wall upper tip. The right frame wall has a right frame wall upper tip. The left frame wall upper tip is angled away from the right frame wall upper tip. The left frame wall upper tip forms a left bevel angle. The right frame wall upper tip forms a right bevel angle.

The left frame wall further includes a left frame wall upper protrusion and a left frame wall lower protrusion. The right frame wall further includes a right frame wall upper protrusion and a right frame wall lower protrusion. The left frame wall upper protrusion and the left frame wall lower protrusion engage the outer portion left wall. The right frame wall upper protrusion and the right frame wall lower protrusion engage the outer portion right wall.

The retainer plate is formed as a retainer plate backer. The retainer plate backer forms a right backer channel and a left backer channel between the retainer plate backer and the carrier rear panel. The frame insert has a left frame wall with a left frame wall rear portion. The left frame wall rear portion lodges in the left backer channel, and the right frame wall has a right frame wall rear portion. The right frame wall rear portion lodges in the right backer channel.

The right bevel angle at least partially engages the right backer channel. The left bevel angle at least partially engages to the left backer channel. The right bevel angle extends from the carrier opening. The left bevel angle extends from the carrier opening. The right backer channel terminates at the carrier opening. The left backer channel terminates at the carrier opening.

The following elements can be a useful guide in referencing the element numbers of the drawings.

10 Rifle Magazine
11 Pistol Magazine
20 Magazine Carrier
21 Carrier Rear Panel
22 Carrier Front Panel
23 Carrier Right Wall
24 Carrier Left Wall
25 Front Panel Tab
26 First Front Panel Slot
27 Second Front Panel Slot
28 Third Front Panel Slot
29 Fourth Front Panel Slot
30 Frame Insert
31 Right Frame Wall
32 Left Frame Wall
33 Frame Opening
34 Bottom Frame Wall
35 Bottom Right Frame Bend
36 Bottom Left Frame Bend
37 Right Frame Wall Lower Protrusion
38 Left Frame Wall Lower Protrusion
39 Right Frame Wall Upper Protrusion
40 Left Frame Wall Upper Protrusion
41 Right Frame Wall Upper Tip
42 Left Frame Wall Upper Tip
43 Left Bevel Angle
44 Right Bevel Angle
45 Left Inside Frame Extension
46 Right Inside Frame Extension
50 Retainer Plate
51 Rib Protrusion
52 Valley
53 Retainer Plate Right Edge
54 Retainer Plate Left Edge
55 Retainer Plate Lower Edge
56 Retainer Plate Top Edge
57 Retainer Plate Backer
58 Carrier Opening
59 Backer Channel
60 Ammunition Carrier
61 Single Carrier
62 Double Carrier
63 First Carrier Rear Panel Slot
64 Second Carrier Rear Panel Slot
65 Third Carrier Rear Panel Slot
71 Right Backer Channel
72 Left Backer Channel
74 Right Frame Wall Rear Portion
75 Left Frame Wall Rear Portion
76 Outer Portion Right Wall
77 Outer Portion Left Wall
78 Upper Portion Middle Wall

DETAILED DESCRIPTION OF THE PREFERRED EMBODIMENT

Figure 1:
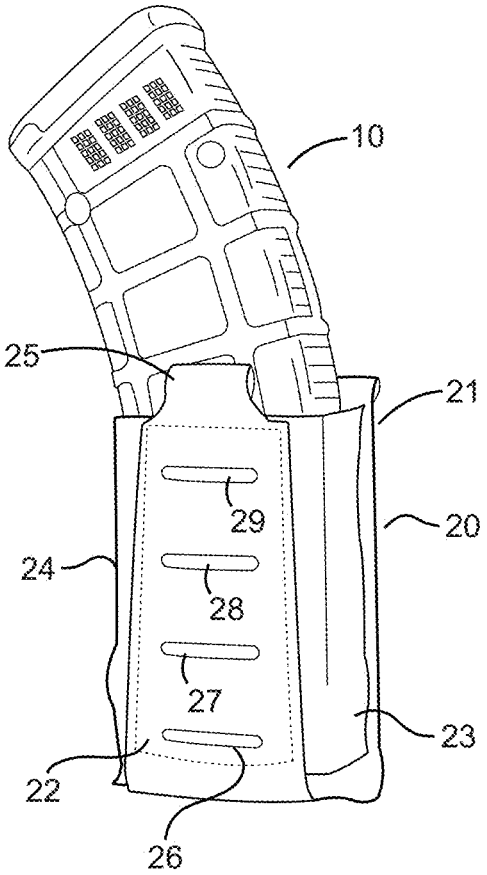
FIG. 1 is a diagram showing the front right of the magazine carrier retaining a rifle magazine.

As seen in FIG. 1, a rifle magazine 10 can be carried in a magazine carrier 20. The magazine carrier 20 has a carrier rear panel 21. The carrier rear panel attaches to equipment or clothing of a user. The carrier rear panel is connected to a carrier front panel 22 by a carrier right wall 23 and a carrier left wall 24. The carrier front panel 22 may have a first front panel slot 26, a second front panel slot 27, a third front panel slot 28, and a fourth front panel slot 29. A front panel tab 25 may allow for easy removal of the rifle magazine 11. A variety of different accessories such as another rifle magazine carrier 20 can attach to the first front panel slot 26, the second front panel slot 27, a third front panel slot 28, and a fourth front panel slot 29. The first front panel slot 26 can be the lowest slot and the fourth front panel slot 29 can be the upper slot. Adjusting the attachment of the accessory to the different slots allows accessory height adjustment.

Figure 2:
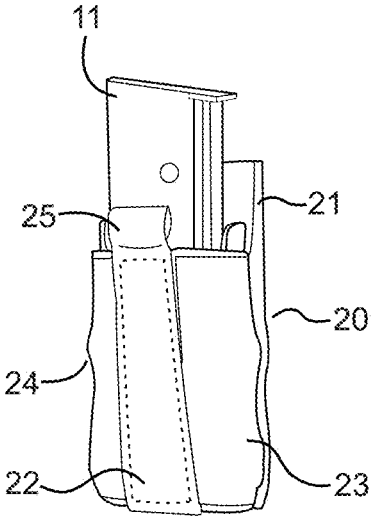
FIG. 2 is a diagram showing the magazine carrier retaining a pistol magazine.

As seen in FIG. 2, a pistol magazine 11 can be carried in a magazine carrier 20. The pistol magazine is retained between the carrier right wall 23, the carrier left wall 24, the carrier front panel 22, and the carrier rear panel 21. A front panel tab 25 may allow easy removal of the pistol magazine 11. As with the rifle magazine, the pistol magazine 11 has its lower end plate pointing upwardly.

Figure 3:
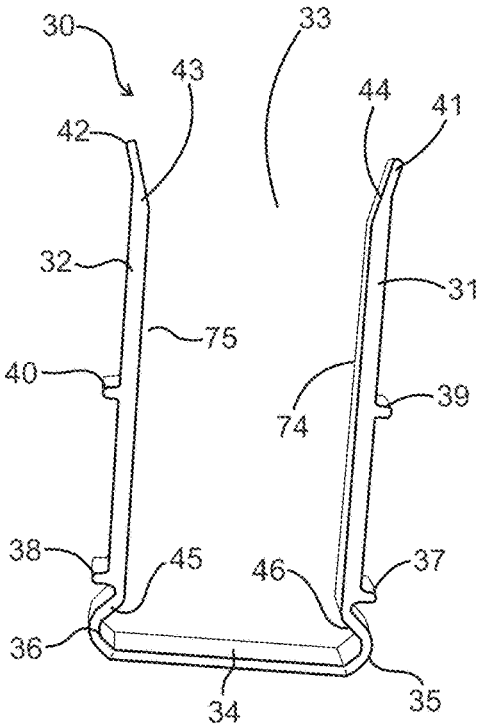
FIG. 3 is a diagram showing an exploded view of the magazine carrier.
Figure 3:
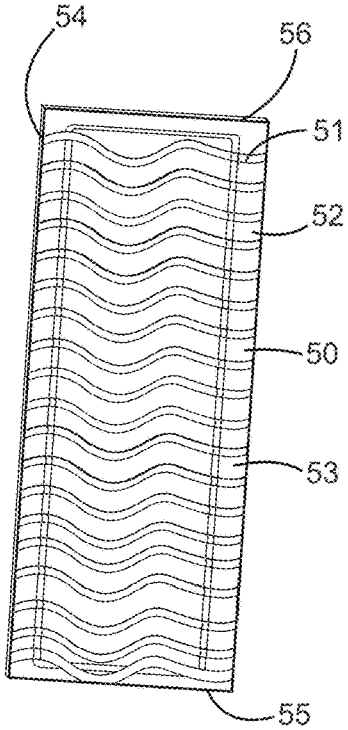
Figure 3:
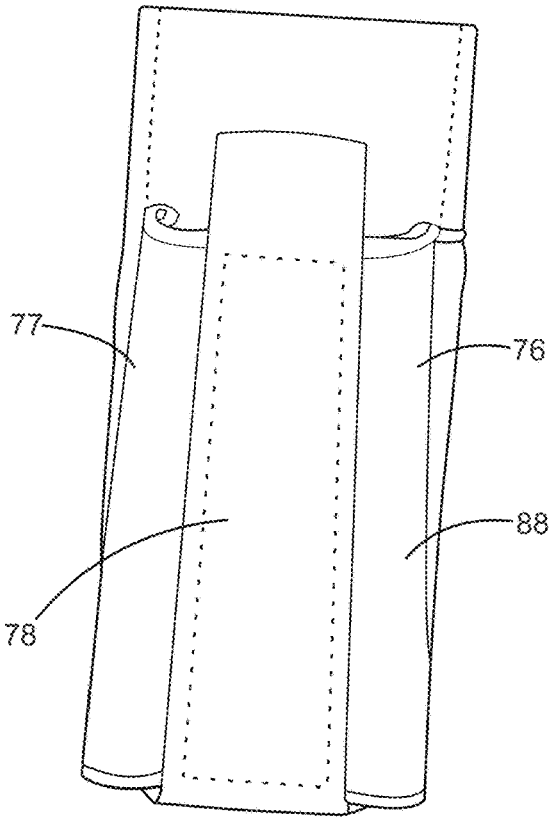

As seen in FIG. 3, an exploded view of the present invention shows that the device has three basic parts, namely the retainer plate 50, the frame insert 30, and the outer portion 88. The retainer plate 50, and the frame insert 30 can be made of flexible high density polyethylene or the like. The outer portion 88 includes an outer portion right wall 76 and an outer portion left wall 77. The outer portion right wall 76 and the outer portion left 77 wall join at an outer portion middle wall 78.

The frame insert has a variety of different features, namely a frame opening 43 which receives the magazine. The magazine is supported at a bottom frame wall 34. A right frame wall 31 and a left frame wall 32 act as a clamp for sandwiching the rifle magazine 10 in between. The right frame wall 31 has a right frame wall upper protrusion 39 and a right frame wall lower protrusion 37 which engage with the outer portion 88 to keep the frame insert 30 retained within the outer portion 88. The left frame wall 32 has a left frame wall upper protrusion 40 and a left frame wall lower protrusion 38 which also engage the outer portion 88 to keep the frame insert 30 retained within the outer portion 88. The right frame wall lower protrusion and the left frame wall lower protrusion are opposite each other and can be used to retain the frame insert 30 within the outer portion 88 such as by engaging inside grooves or pockets of the outer portion 88.

The outer portion 88 can be formed as a heavy fabric pouch. The right frame wall 31 and the left frame wall 32 can have a right frame wall upper tip 41 and a left frame wall upper tip 42. The right frame wall upper tip 41 may have a right bevel angle 44 and the left frame wall upper tip can have a left bevel angle 43. The upper tips can narrow to provide a more flexible bias and allow a user to grasp the upper tips by pressing them away from the magazine 10. Additionally, the bevel angles provide a funnel channel shape for angle magazines such as thirty round modern rifle magazines.

The frame insert 30 has a bottom right frame bend 35 and a bottom left frame bend 36. The bottom right frame bend 35 extends outwardly from the right frame wall 31 where the right frame wall 31 meets the bottom frame wall 34. Similarly, the bottom left frame bend 36 extends hourly from the left frame wall 32 where the left frame wall 32 meets the bottom frame wall 34. The left inside frame extension 45 bends backward to the frame insert 30 and the right inside frame extension 46 bends backward to the frame insert 30. The backwards bend provides a more flexible spring configuration. The backwards bend area and the bottom frame wall 34 area are thinner than the right frame wall 31 and the left frame wall 32. The right frame wall 31 and the left frame wall 32 can be twice as thick as the bottom frame wall 34.

The frame insert 30 fits into the outer portion 88. Before inserting the frame insert 30, a user inserts the retainer plate 50. The retainer plate 50 is a flat plate having ribs or ridges or other surface roughness on an engaging surface facing the magazine. The retainer plate 50 has rib protrusions 51. The rib protrusions 51 can be formed as waves to resist sideways motion of a jiggly magazine when a magazine is subject to vibrations such as when a user is running. The rib protrusions can be formed as an array of regular ridges or ribs forming valleys 52 between them. The retainer plate 50 is generally rectangular with a retainer plate right edge 53, a retainer plate lower edge 55, a retainer plate left edge 54, and a retainer plate top edge 56.

Figure 4:
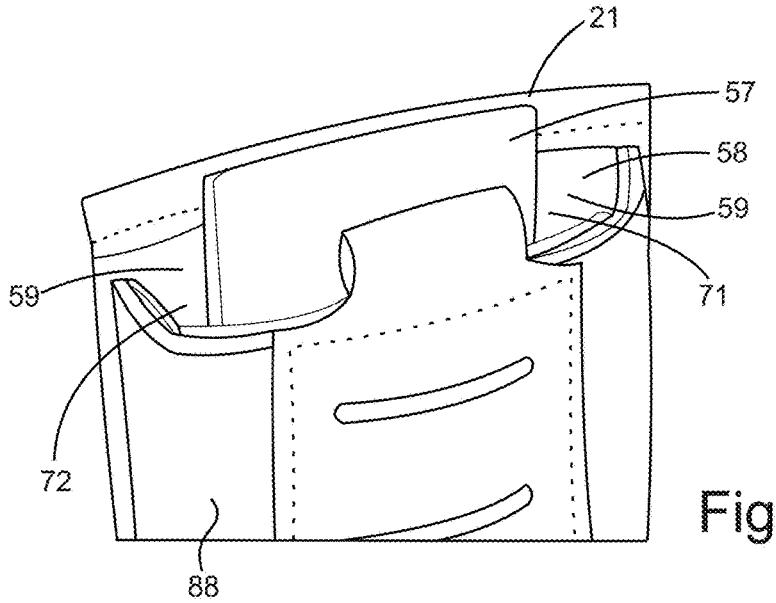
FIG. 4 is a diagram showing a retainer plate backer inserted into the magazine carrier.

As seen in FIG. 4, the outer portion 88 has a carrier opening 58 which receives the rifle magazine 10. The carrier opening 58 shows a retainer plate backer 57 mounted to the carrier rear panel 21. The retainer plate backer 57 can be formed as a fabric or plastic sheet that has a thickness. The thickness of the retainer plate backer 57 offsets it from the carrier rear panel 21 forming a pair of backer channels 59 because the retainer plate backer 57 is not as wide as the carrier opening 58. The backer channels 59 then retain the frame insert 30. Namely, the right backer channel retains the right frame wall 31 and the left backer channel retains the left frame wall 32. The frame insert fits in the backer channel and has a width that is less than a width of the frame insert from the left frame wall to the right frame wall.

The retainer plate is formed as a retainer plate backer. The retainer plate backer forms a right backer channel 71 and a left backer channel 72 between the retainer plate backer and the carrier rear panel. The frame insert has a left frame wall with a left frame wall rear portion 75. The left frame wall rear portion 75 lodges in the left backer channel, and the right frame wall has a right frame wall rear portion 74. The right frame wall rear portion 74 lodges in the right backer channel 72.

Figure 5:
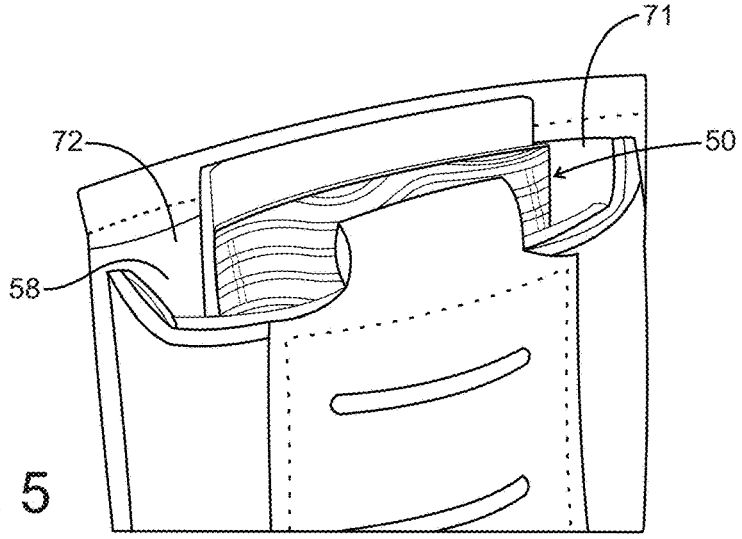
FIG. 5 is a diagram showing a retainer plate inserted into the magazine carrier.
Figure 6:
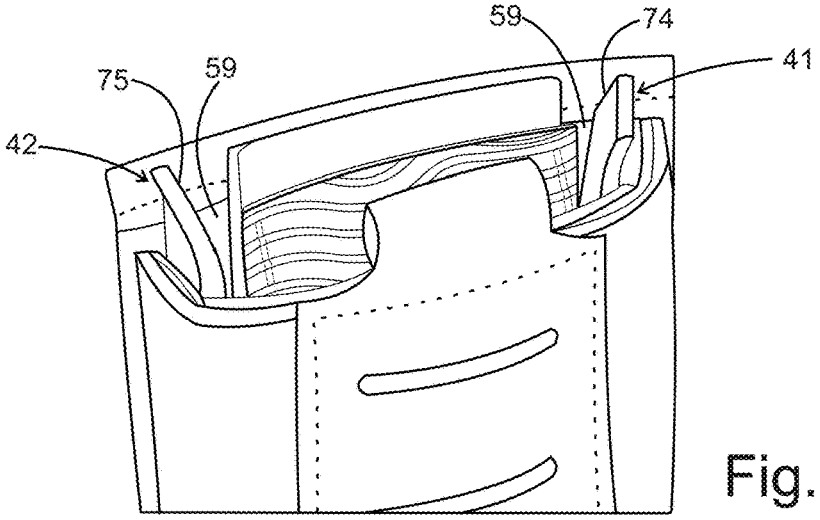
FIG. 6 is a diagram showing a frame insert inserted into the magazine carrier.

As seen in FIG. 5, the retainer plate 50 has been inserted into the carrier opening 58. As seen in FIG. 6, the frame insert 30 is inserted into the carrier opening 58. The frame insert 30 has upwardly extending tips namely the right frame wall upper tip 41 and the left frame wall upper tip 42. The right frame wall upper tip 41 and the left frame wall upper tip 42 are movable within the backer channels 59. The backer channels 59 define a range of motion for the right frame wall upper tip 41 and the left frame wall upper tip 42.

Figure 7:
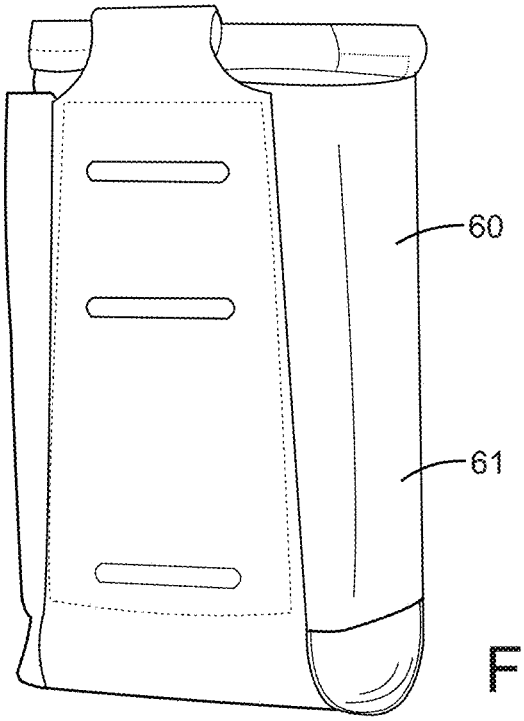
FIG. 7 is a diagram showing the magazine carrier in a single carrier configuration.

As seen in FIG. 7, an ammunition carrier 60 can be a single carrier 61.

Figure 8:
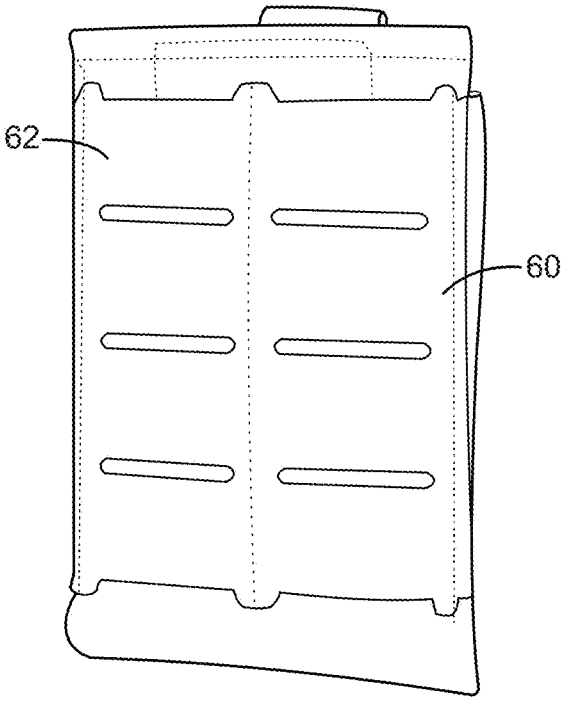
FIG. 8 is a diagram showing the magazine carrier in double carrier configuration.

As seen in FIG. 8, an ammunition carrier can be a double carrier 62.

Figure 9:
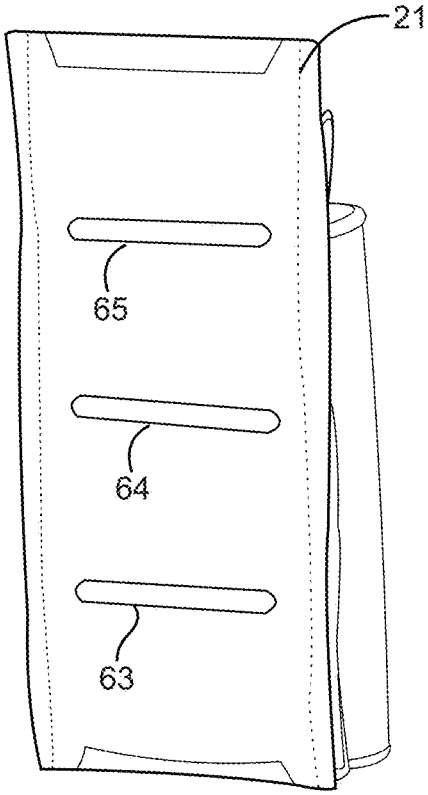
FIG. 9 is a diagram showing a rear side of the magazine carrier including carrier panel rear slots.
Figure 10:
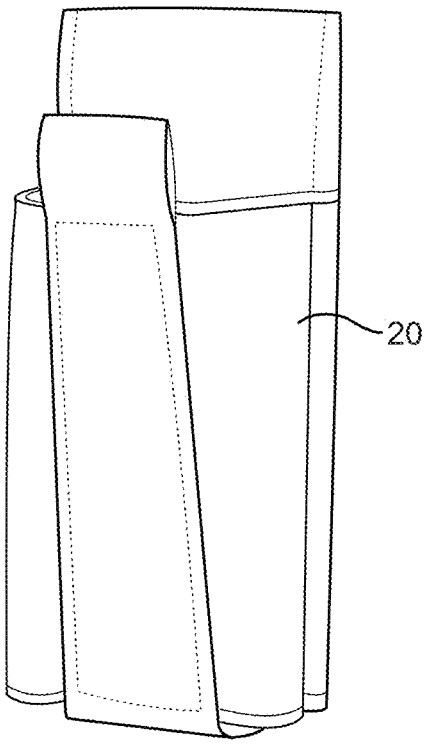
FIG. 10 is a diagram showing a magazine carrier.

As seen in FIG. 9, the carrier rear panel 21 may further include a first carrier rear panel slot 63, a second carrier rear panel slot 64, and a third carrier rear panel slot 65.

The invention claimed is:

1. A magazine carrier comprising:

a. a frame insert, wherein the frame insert includes a bottom frame wall, a right frame wall, and a left frame wall, wherein the bottom frame wall connects to the right frame wall and the left frame wall;

b. a retainer plate, wherein the retainer plate has a retainer plate lower edge opposite a retainer plate upper edge, and a retainer plate right edge opposite a retainer plate left edge, wherein the retainer plate further includes protrusions; and c. an outer portion, wherein the frame insert retained within the outer portion, wherein the retainer plate retains within the outer portion, wherein the outer portion is formed as a flexible container with a carrier opening that receives the frame insert and retainer plate, wherein the outer portion includes an outer portion right wall and an outer portion left wall, wherein the outer portion right wall and the outer portion left wall join at an outer portion middle wall.

2. The magazine carrier of claim 1, wherein the protrusions are rib protrusions.

3. The magazine carrier of claim 2, wherein the rib protrusions extend from the retainer plate left edge to the retainer plate right edge.

4. The magazine carrier of claim 1, wherein the left frame wall has a left frame wall upper tip, wherein the right frame wall has a right frame wall upper tip, wherein the left frame wall upper tip is angled away from the right frame wall upper tip, wherein the left frame wall upper tip forms a left bevel angle, wherein the right frame wall upper tip forms a right bevel angle.

5. The magazine carrier of claim 1, wherein the left frame wall further includes a left frame wall upper protrusion and a left frame wall lower protrusion, wherein the right frame wall further includes a right frame wall upper protrusion and a right frame wall lower protrusion, wherein the left frame wall upper protrusion and the left frame wall lower protrusion engage the outer portion left wall, wherein the right frame wall upper protrusion and the right frame wall lower protrusion engage the outer portion right wall.

6. The magazine carrier of claim 1, wherein the retainer plate is formed as a retainer plate backer, wherein the retainer plate backer forms a right backer channel and a left backer channel between the retainer plate backer and the carrier rear panel, wherein the frame insert, wherein the left frame wall has a left frame wall rear portion, wherein the left frame wall rear portion lodges in the left backer channel, and wherein the right frame wall has a right frame wall rear portion, wherein the right frame wall rear portion lodges in the right backer channel.

7. The magazine carrier of claim 6, wherein the protrusions are rib protrusions.

8. The magazine carrier of claim 7, wherein the rib protrusions extend from the retainer plate left edge to the retainer plate right edge.

9. The magazine carrier of claim 6, wherein the left frame wall has a left frame wall upper tip, wherein the right frame wall has a right frame wall upper tip, wherein the left frame wall upper tip is angled away from the right frame wall upper tip, wherein the left frame wall upper tip forms a left bevel angle, wherein the right frame wall upper tip forms a right bevel angle.

10. The magazine carrier of claim 6, wherein the left frame wall further includes a left frame wall upper protrusion and a left frame wall lower protrusion, wherein the right frame wall further includes a right frame wall upper protrusion and a right frame wall lower protrusion, wherein the left frame wall upper protrusion and the left frame wall lower protrusion engage the outer portion left wall, wherein the right frame wall upper protrusion and the right frame wall lower protrusion engage the outer portion right wall.

11. The magazine carrier of claim 10, wherein the protrusions are rib protrusions.

12. The magazine carrier of claim 11, wherein the rib protrusions extend from the retainer plate left edge to the retainer plate right edge.

13. The magazine carrier of claim 10, wherein the left frame wall has a left frame wall upper tip, wherein the right frame wall has a right frame wall upper tip, wherein the left frame wall upper tip is angled away from the right frame wall upper tip, wherein the left frame wall upper tip forms a left bevel angle, wherein the right frame wall upper tip forms a right bevel angle.

14. The magazine carrier of claim 13, wherein the right bevel angle at least partially engages to the right backer channel, wherein the left bevel angle at least partially engages to the left backer channel, wherein the right bevel angle extends from the carrier opening, wherein the left bevel angle extends from the carrier opening, wherein the right backer channel terminates at the carrier opening, wherein the left backer channel terminates at the carrier opening.

15. The magazine carrier of claim 14, wherein the protrusions are rib protrusions.

16. The magazine carrier of claim 15, wherein the rib protrusions extend from the retainer plate left edge to the retainer plate right edge.

* * * * *